US011291247B1

(12) United States Patent
Oliver, III

(10) Patent No.: US 11,291,247 B1
(45) Date of Patent: Apr. 5, 2022

(54) ILLUMINATING HANDHELD SMOKING ARTICLE

(71) Applicant: Louis Oliver, III, Sunrise, FL (US)

(72) Inventor: Louis Oliver, III, Sunrise, FL (US)

(73) Assignee: Highlightz International, Inc., Sunrise, FL (US)

( * ) Notice: Subject to any disclaimer, the term of this patent is extended or adjusted under 35 U.S.C. 154(b) by 0 days.

(21) Appl. No.: 17/169,383

(22) Filed: Feb. 5, 2021

Related U.S. Application Data

(62) Division of application No. 29/750,317, filed on Sep. 12, 2020.

(51) Int. Cl.

| | |
|---|---|
| ***A24F 40/40*** | (2020.01) |
| ***A24F 40/51*** | (2020.01) |
| ***F21V 33/00*** | (2006.01) |
| ***F21Y 115/10*** | (2016.01) |

(52) U.S. Cl.
CPC ..... *A24F 40/40* (2020.01); *A24F 40/51* (2020.01); *F21V 33/0004* (2013.01); *F21Y 2115/10* (2016.08)

(58) Field of Classification Search
None
See application file for complete search history.

(56) References Cited

U.S. PATENT DOCUMENTS

| | | | | |
|---|---|---|---|---|
| 2,830,593 | A | 4/1958 | Campbell | |
| 5,269,327 | A | 12/1993 | Counts et al. | |
| D485,639 | S | 1/2004 | Stronski | |
| D588,741 | S | 3/2009 | Murdaugh, III et al. | |
| 8,156,844 | B2 | 4/2012 | Han | |
| 8,539,959 | B1 * | 9/2013 | Scatterday | A61M 15/06 131/361 |
| D692,613 | S | 10/2013 | Morreale | |
| 9,427,022 | B2 | 8/2016 | Levin et al. | |
| 10,104,909 | B2 | 10/2018 | Han et al. | |
| D838,900 | S | 1/2019 | Freese | |
| 2007/0000502 | A1 * | 1/2007 | Chong | A24F 15/18 131/249 |
| 2011/0277757 | A1 * | 11/2011 | Terry | A61M 15/06 128/202.21 |
| 2015/0216234 | A1 | 8/2015 | Chung | |
| 2015/0216236 | A1 * | 8/2015 | Bless | A24F 40/40 131/328 |
| 2015/0223520 | A1 * | 8/2015 | Phillips | A61M 15/06 131/328 |
| 2016/0066619 | A1 | 3/2016 | Di Carlo | |
| 2016/0192712 | A1 * | 7/2016 | Memari | B65D 25/005 141/2 |
| 2016/0235118 | A1 | 8/2016 | Riederer | |

(Continued)

*Primary Examiner* — Timothy Kennedy
*Assistant Examiner* — Guy F Mongelli
(74) *Attorney, Agent, or Firm* — Mark C. Johnson; Johnson Dalal

(57) ABSTRACT

The invention provides an illuminating handheld smoking article that generally includes a handheld body, an LED cover, an LED assembly, an LED activation assembly, and a self-contained power source. This article overcomes the disadvantages of detection, short battery life, and difficulties presented with holding small objects by incorporating illumination, activation upon airflow sensing, and a larger gripping surface into the design, respectively. The smoking article enables safe and effective coupling with an item to be smoked.

20 Claims, 12 Drawing Sheets

(56) References Cited

U.S. PATENT DOCUMENTS

| | | | | |
|---|---|---|---|---|
| 2016/0262453 | A1* | 9/2016 | Ampolini | H05B 3/0033 |
| 2016/0270438 | A1* | 9/2016 | Jackson | A24F 1/00 |
| 2017/0099878 | A1 | 4/2017 | Murison et al. | |
| 2017/0273355 | A1* | 9/2017 | Rogers | A24F 40/40 |
| 2018/0160730 | A1* | 6/2018 | Bless | H05B 1/0244 |
| 2018/0242640 | A1* | 8/2018 | Borkovec | A24F 40/485 |

* cited by examiner 2-2

7-7

8-8

14-14

11-11

ILLUMINATING HANDHELD SMOKING ARTICLE

FIELD OF THE INVENTION

The present invention relates generally to smoking articles, and, more particularly, relates to handheld smoking articles configured to retain a conventional cigarette or other similar structure and illuminate.

BACKGROUND OF THE INVENTION

Many individuals partake in smoking cigarettes, cigars, and other similar items. Holding these items effectively and safely can be problematic for many users, particular those with disabilities. Further, there have been many instances while a user is smoking that the item, whereby the item smoked causes harm to the user and/or others in the nearby vicinity due to inadvertent contact with the heated portion of the item smoked. Moreover, many establishments that do permit smoking inside or outside of the establishment require that smoking only occur in designated locations.

There have been smoking articles developed that do help retain smoking items, but they fail to sufficiently address the above-referenced concerns due to the smoked item still being inconspicuous or otherwise not sufficiently visually perceivable in order to avoid contact with the item being smoke or identifying who is smoking in or on an establishment. Moreover, known smoking articles that are operable to illuminate, fail to do so in an effective and efficient manner. Specifically for example, some smoking articles are only illuminated when a user activates a switch. As many users will forget to deactivate the switch upon activation, the power source located on the smoking article is quickly depleted. Additionally, other smoking articles are illuminated only at a specific spot or the illumination can be viewed only at specific angles to the observer resulting in unreliable detection of the users.

Therefore, a need exists to overcome the problems with the prior art as discussed above.

SUMMARY OF THE INVENTION

The invention provides an illuminating handheld smoking article that overcomes the hereinafore-mentioned disadvantages of the heretofore-known devices and methods of this general type and that enables selective illumination of the smoking article while also enabling safe and effective coupling with a smoked item.

With the foregoing and other objects in view, there is provided, in accordance with the invention, an illuminated handheld smoking article is disclosed that generally includes a handheld body, an LED cover, an LED assembly, an LED activation assembly, and a self-contained power source. The handheld body includes a first end defining an opening, a second end opposite the first end and defines an opening, defining a body air passageway separating the openings defined by the first and second ends, respectively, of the handheld body. The LED cover has a first end defining an opening, a second end opposite the first end of the LED cover and defines an opening, has an inner wall enclosing and defining a cover air passageway separating the openings defined by the first and second ends, respectively, of the LED cover. The LED cover also has an outer wall of a translucent material defining a perimeter thereon and enclosing and defining, with the inner wall, a LED cavity. The body air passageway and the cover air passageway define a continuous article air passageway separating the opening defined by the first end of the handheld body and the opening defined by the second end of the LED cover. The LED assembly is disposed within the LED cavity and has at least one LED operably configured to emit light radially outwardly from the surrounding outer wall of the LED cover. The LED activation assembly is coupled to the illuminated handheld smoking article, fluidly coupled to the body air passageway, and has an activation circuit. The self-contained power source is electrically coupled to the LED activation assembly and the LED assembly, wherein the activation circuit is operably configured to selectively and autonomously complete a circuit with at least one LED and the self-contained power source upon receiving an airflow across the LED activation assembly and at least partially through the body air passageway and emit light radially outwardly from the surrounding outer wall of the LED cover.

In accordance with a further feature of the present invention, the LED cavity is of a cylindrical shape.

In accordance with a further feature of the present invention, which at least one LED is positioned directly adjacent to an inner surface of the outer wall of the LED cover.

In accordance with a further feature of the present invention, which the LED activation assembly includes the electronic airflow sensor that is electrically coupled to the self-contained power source and the activation circuit that is operably configured to selectively and autonomously complete the circuit with at least one LED and the self-contained power source upon receiving an airflow across the electronic airflow sensor.

In accordance with another feature, an embodiment of the present invention includes the electronic airflow sensor is disposed in the LED cavity within the LED cover.

In accordance with a further feature of the present invention, which the outer wall and the inner wall are positioned in a longitudinal orientation and meet to form a joint defining the second end of the LED cover. The inner wall includes a portion extending inwardly from the second end of the LED cover and terminating at an inner wall free end enclosing an inner wall aperture through which air can flow.

In accordance with another feature, an embodiment of the present invention includes at least one LED within the LED cavity and the LED is positioned directly adjacent and directly coupled to an inner surface of the LED cover's outer wall.

In accordance with yet another feature of the present invention, which the outer wall may include at least one enclosed intake aperture located proximal to the second end of the LED cover. The intake aperture is fluidly coupled to the LED cavity, the openings, and the body air passageway that is defined by the first end of the handheld body.

In accordance with another feature, an embodiment of the present invention, which the outer wall may include two enclosed intake apertures disposed and defined on two opposing sides.

With the foregoing and other objects in view, there is provided, in accordance with the invention, another embodiment of an illuminated handheld smoking article is disclosed that generally includes a handheld body, an LED cover, an LED assembly, an LED activation assembly, and a self-contained power source. The handheld body includes a first end defining an opening, a second end opposite the first end and defines an opening, defining a body air passageway separating the openings defined by the first and second ends, respectively, of the handheld body. The LED cover has a first end defining an opening, a second end opposite the first end of the LED cover and defines an opening, has an inner wall enclosing and defining a cover air passageway separating the openings defined by the first and second ends, respectively, of the LED cover. The LED cover also has an outer wall of a translucent material defining a perimeter thereon and enclosing and defining, with the inner wall, a LED cavity. The body air passageway and the cover air passageway define a continuous article air passageway separating the opening defined by the first end of the handheld body and the opening defined by the second end of the LED cover. The LED assembly is disposed within the LED cavity and has at least one LED operably configured to emit light radially outwardly from the surrounding outer wall of the LED cover. The LED activation assembly is coupled to the handheld body, at least partially within the body air passageway, and has an activation circuit. The self-contained power source is electrically coupled to the LED activation assembly and the LED assembly, wherein the activation circuit is operably configured to selectively and autonomously complete a circuit with at least one LED and the self-contained power source upon receiving an airflow across the LED activation assembly through the continuous article air passageway and emit light radially outwardly from the outer wall of the LED cover.

In accordance with a further feature of the present invention, where the openings are enclosed and are defined by the first end of the handheld body and the second end of the LED cover.

In accordance with a further feature of the present invention, which the LED activation assembly includes a sensor that is electrically coupled to the self-contained power source.

In accordance with a yet another feature of the present invention, which the LED activation assembly includes a spring-loaded lever assembly having an electrical switch that is electrically coupled to the self-contained power source.

In accordance with a further feature, an embodiment of the present invention, which the inner wall of the LED cover is hermetically sealed to the handheld body.

In accordance with another feature, an embodiment of the present invention, where the inner wall of the LED cover has a discontinuous slot that extends from the first end of the LED cover in which a portion of the LED activation assembly is located.

In accordance with yet another feature, an embodiment of the present invention, which the outer wall material is translucent and spans from the second end of the LED cover to the first end.

In accordance with yet another feature, an embodiment of the present invention, which the outer or inner wall is extended with a permeable material to fully enclose the smoker's item. The extension may be removable.

Although the invention is illustrated and described herein as embodied in an illuminating handheld smoking article, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper", "lower", "left," "rear," "right," "front," "vertical," "horizontal," and derivatives thereof relate to the invention as oriented in the figures and is not to be construed as limiting any feature to be a particular orientation, as said orientation may be changed based on the user's perspective of the device. Furthermore, there is no intention to be bound by any expressed or implied theory presented in the preceding technical field, background, brief summary or the following detailed description.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the illuminating handheld smoking article, spanning from an end where air is received into the smoking article and to an end where air is emitted from the smoking article. In addition, the use of "proximal" means at or near (within 15-20% of the overall length or distance of) the referred to item. The term "translucent" encompasses any substance through which allows light to radiate; this can include any substance that is not opaque. The term "LED" describes any item that emits light, which can include encased or open filaments and may or may not be coupled to circuitry or electronics.

The terms "program," "software application," and the like as used herein, are defined as a sequence of instructions designed for execution on a computer system. A "program," "computer program," or "software application" may include a subroutine, a function, a procedure, an object method, an object implementation, an executable application, an applet, a servlet, a source code, an object code, a shared library/dynamic load library and/or other sequence of instructions designed for execution on a computer system.

BRIEF DESCRIPTION OF THE DRAWINGS

The accompanying figures, where like reference numerals refer to identical or functionally similar elements throughout the separate views and which, together with the detailed description below are incorporated in and form part of the specification, serve to further illustrate various embodiments and explain various principles and advantages all in accordance with the present invention.

DETAILED DESCRIPTION

Figure 2:
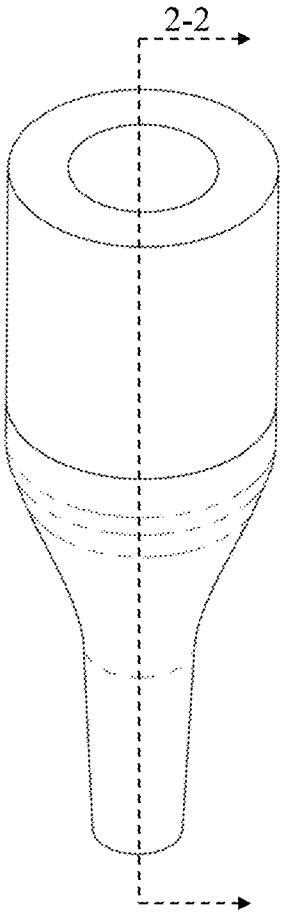
FIG. 2 is another perspective view of the illuminating handheld smoking article in FIG. 1.
Figure 1:
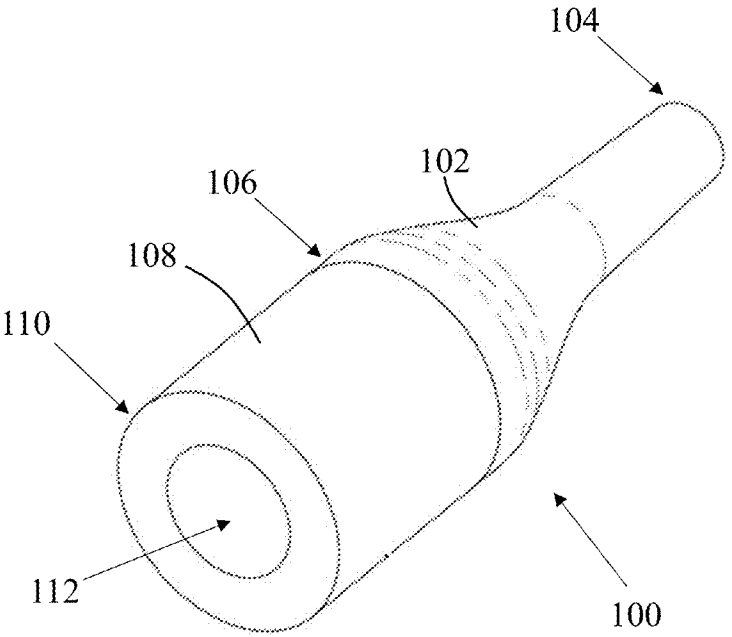
FIG. 1 is a perspective view of an illuminating handheld smoking article in accordance with one embodiment of the present invention.
Figure 3:
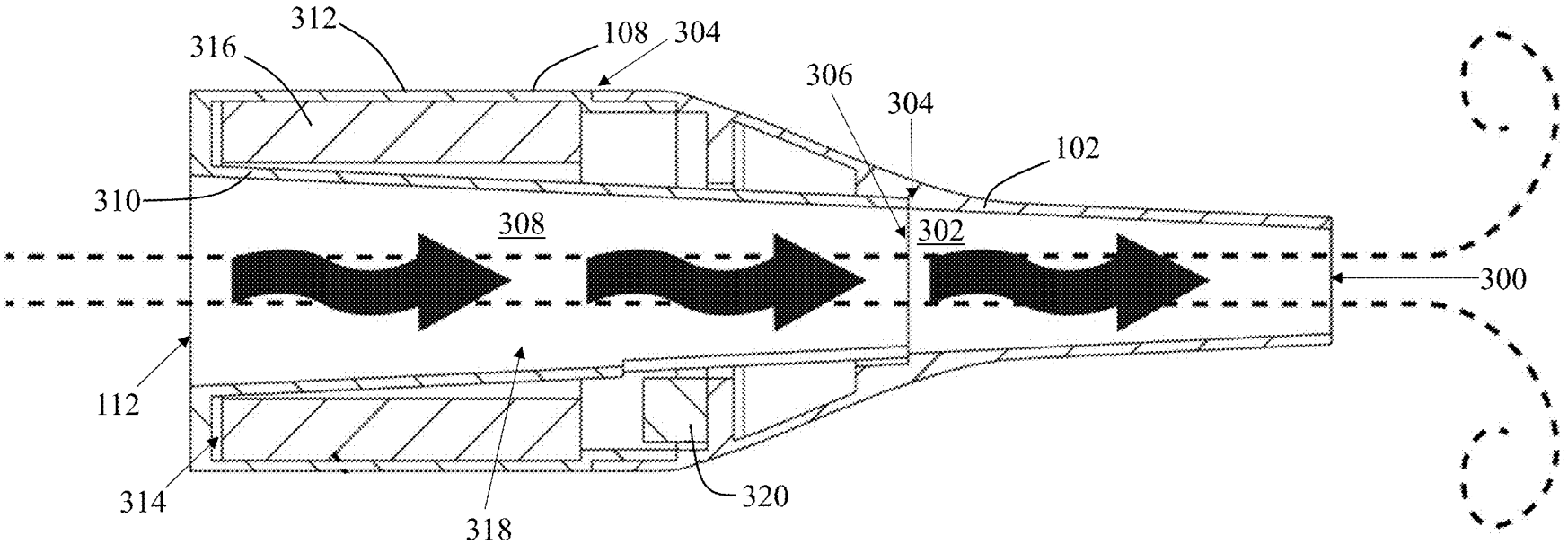
FIG. 3 is a cross-sectional view of the illuminating handheld smoking article in FIG. 2 along section line 2-2.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

It should be understood that terms such as, "front," "rear," "side," top," "bottom," and the like are indicated from the reference point of a viewer viewing the illuminate handheld smoking device 1600, 100 from its front end 1604, 104 when the device is held by the user in two different embodiments. As used herein, the term "wall" is intended broadly to encompass continuous structures, as well as, separate structures that are coupled together so as to form a substantially continuous external surface.

The present invention provides a novel and efficient illuminating handheld smoking article that effectively and safely enables users to hold and retain a smoking item (e.g., a cigarette), while effectively enabling illumination in an effective, efficient, safe, and useful manner. Referring now to FIGS. 1-10 and 15, one embodiment of the present invention is shown. FIGS. 1-10 and 15 show several advantageous features of the present invention, but, as will be described below, the invention can be provided in several shapes, sizes, combinations of features and components, and varying numbers and functions of the components. For example, another embodiment of an illuminating handheld smoking article is depicted in FIGS. 16-25. The first example of an illuminated handheld smoking article 100, as shown in FIGS. 1-10 and 15, includes a handheld body 102 with a first end 104 defining an opening 300, a second end 106 opposite the first end 104 and defining an opening 500, defining a body air passageway 302 separating the openings 300, 500 defined by the first and second ends 104, 106, respectively, of the handheld body 102. The illuminated handheld smoking article 100 may have an approximate length of 60 mm with various sized openings and apertures ranging from 2 mm to 20 mm. In one embodiment, the openings 300, 500 are preferably, but not necessarily, enclosed.

In one embodiment, the illuminated handheld smoking article 100 may be one continuous piece or more than one piece coupled together that includes some or all of the components and features described herein. Additionally, more than one type of material, ranging from opaque to transparent and permeable to impermeable, may be used in manufacturing the illuminated handheld smoking article 100 based on the individual component requirement.

The article also comprises an LED cover 108 with a first end 304 defining an opening 306 (that may be enclosed), a second end 110 opposite the first end 304 of the LED cover 108 and defining an opening 112 (that may be enclosed) having an inner wall 310 enclosing and defining a cover air passageway 308 separating the openings 306, 112 defined by the first and second ends 304, 110, respectively, of the LED cover 108. The LED cover 108 also having an outer wall 312 of a translucent material that extends around the outer circumference of an LED 402 and defining, with the inner wall 310, a cylindrical LED cavity 314, the body air passageway 302 and cover air passageway 308 defining a continuous article air passageway 318 separating the opening 300 defined by the first end 104 of the handheld body 102 and the opening 112 defined by the second end 110 of the LED cover 108. Whereas in another embodiment, the outer wall 312 is of a translucent material spanning from the second end 110 of the LED cover 108 to the first end 304 or the LED cover material is transparent for greater light emission and detection from a distance. Further, an embodiment where the opening 300 defined by the first end 104 of the handheld body 102 and the opening 112 defined by the second end 110 of the LED cover 108 are enclosed. In a similar setup, the illuminated handheld smoking article may have the inner wall 310 of the LED cover 108 coupled to the handheld body 102 in a hermetically sealed configuration and the LED cover may have a discontinuous slot 400 formed thereon and extending from the first end 304 of the LED cover 108, wherein a portion of the LED activation assembly 1510 may be disposed within the discontinuous slot 400.

The article includes an LED assembly 316 positioned within and surrounding (partially or completely) the cylindrical LED cavity 314 and having at least one annular LED operably configured to emit light radially outwardly from the surrounding outer wall 312 of the LED cover 108. The illuminated handheld smoking article 100 has an LED activation assembly 600 coupled (mechanically or through compression) to the handheld body 102, which is at least partially disposed within or is otherwise fluidly coupled to the body air passageway 302, and has an activation circuit 1500 and a self-contained power source 1502 (e.g., 6-12V) electrically coupled to the LED activation assembly 1510 and the LED assembly 316. The activation circuit 1500 is operably configured to selectively and autonomously complete a circuit with at least one LED and self-contained power source 1502 solely when receiving an airflow through the continuous article air passageway 318. In another embodiment, the sensor 320 is electrically coupled to the self-contained power source 1502. In a different embodiment, the LED activation assembly 1510 further comprises a spring-loaded lever assembly 600 having an electrical switch 320 electrically coupled to the self-contained power source 1502.

Figure 6:
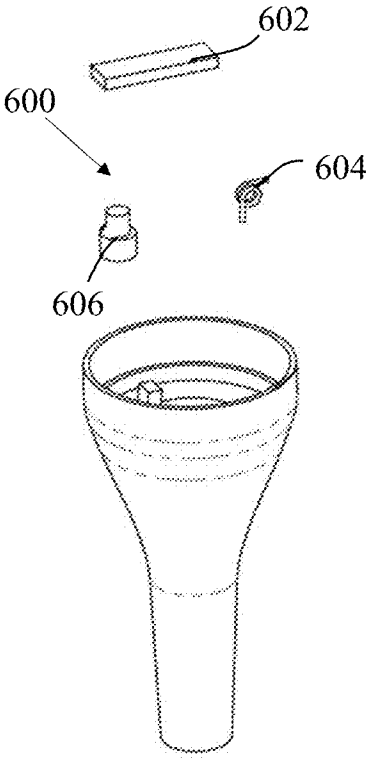
FIG. 6 is an exploded view of a handheld body and LED activation assembly utilized in the illuminating handheld smoking article in accordance with another embodiment of the present invention.
Figure 5:
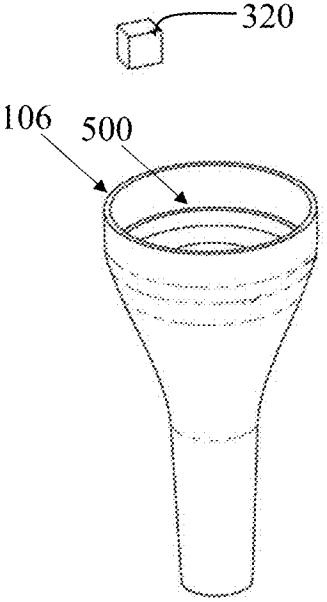
FIG. 5 is an exploded view of a handheld body and LED activation assembly utilized in the illuminating handheld smoking article in accordance with one embodiment of the present invention.
Figure 4:
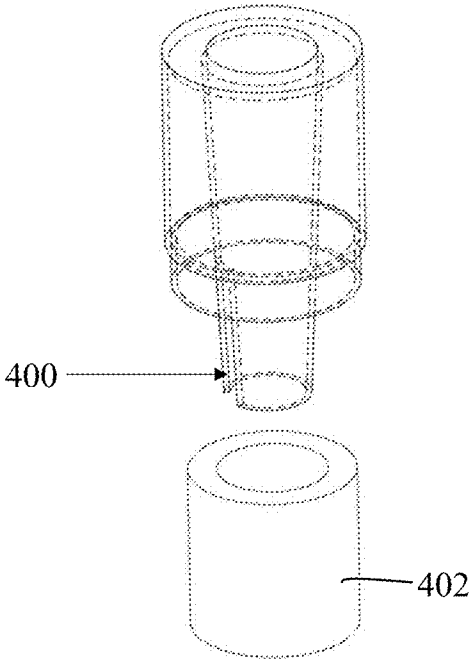
FIG. 4 is an exploded view of an LED cover and LED in accordance with one embodiment of the present invention.
Figure 10:
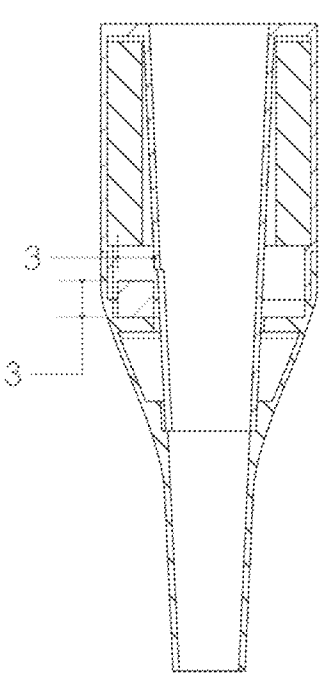
FIG. 10 is a cross-sectional view of the illuminating handheld smoking article in FIG. 7 along section line 7-7.
Figure 9:
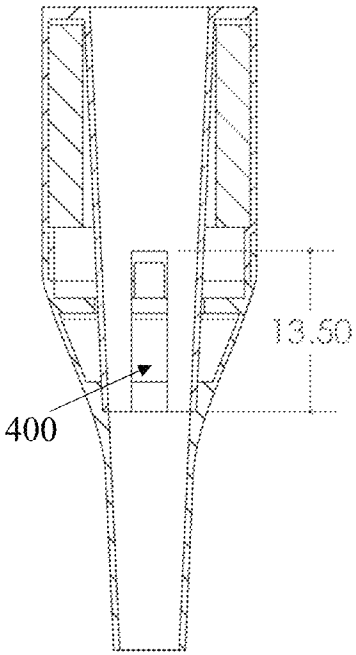
FIG. 9 is a cross-sectional view of the illuminating handheld smoking article in FIG. 8 along section line 8-8.
Figure 8:
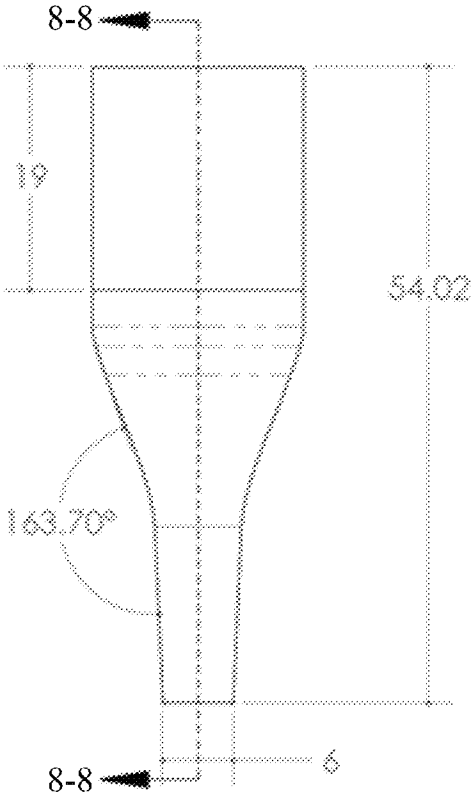
FIG. 8 is an elevational side view of the illuminating handheld smoking article in FIG. 7.
Figure 7:
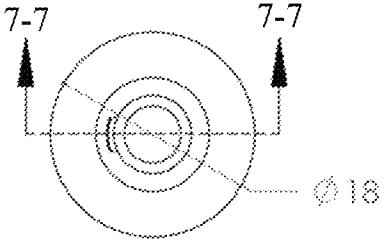
FIG. 7 is a top plan view of an illuminating handheld smoking article in accordance with another embodiment of the present invention.
Figure 14:
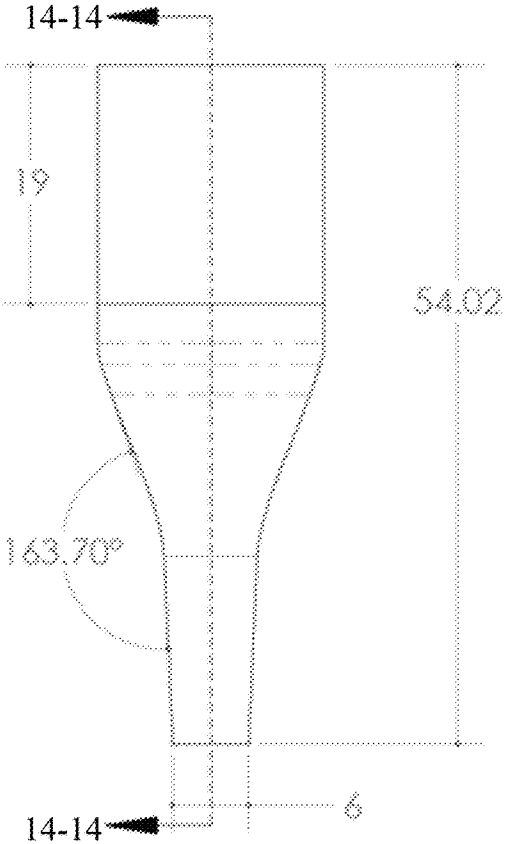
FIG. 14 is an elevational side view of the illuminating handheld smoking article in FIG. 11.
Figure 13:
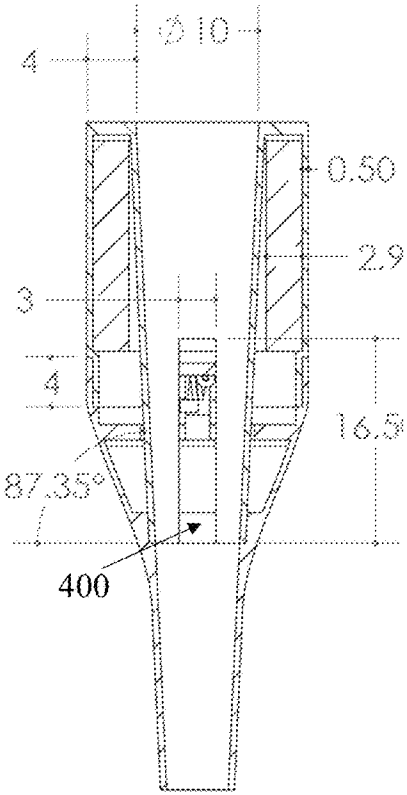
FIG. 13 is a cross-sectional view of the illuminating handheld smoking article in FIG. 14 along section line 14-14.
Figure 12:
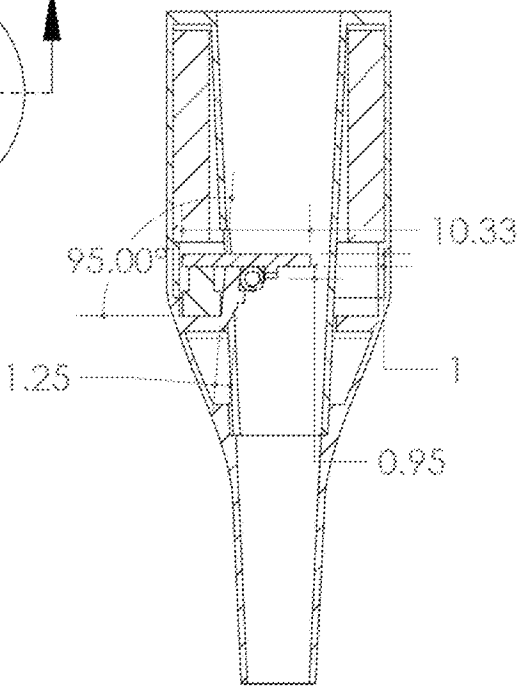
FIG. 12 is a cross-sectional view of the illuminating handheld smoking article in FIG. 11 along section line 11-11.
Figure 11:
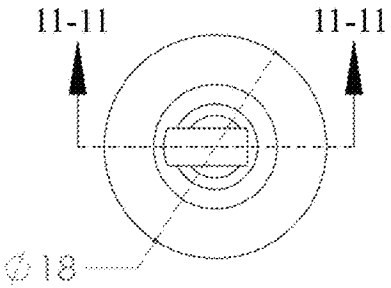
FIG. 11 is a top plan view of an illuminating handheld smoking article in accordance with another embodiment of the present invention.

To that end, as best shown in FIG. 6, the spring-loaded lever assembly 600 includes a pivot member 602 pivotably coupled to the spring 604, whereby the pivot member 602 is operably configured to rotate off the switch 606 (electrically connected to the power source) when an airflow (is generated within the cover air passageway 308 and causing the LED to emit light. Whether utilizing a pivot member 602 or a sensor 320, the pivot member 602 is configured to rotate and the sensor is operable to detect an airflow when approximately 5-25 psi is generated within the cover air passageway 308.

In another embodiment, FIGS. 11-14 shows exemplary dimensions and geometry of the handheld body and article air passageway which can provide a user-friendly shape to those with facial muscle difficulties. Specifically, the illuminated handheld smoking article depicted in FIG. 6 and FIGS. 11-14 depicts the embodiment with the spring-loaded lever assembly 600.

Figure 15:
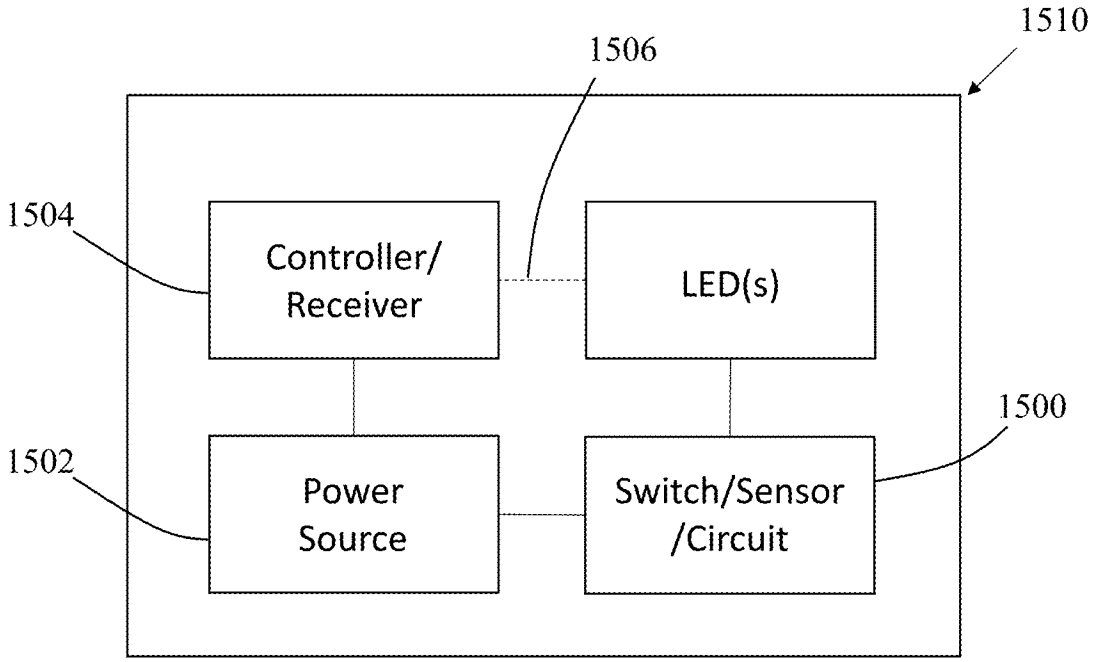
FIG. 15 is a block diagram depicting the electrical and other components of an illuminating handheld smoking article in accordance with embodiments of the present invention.
Figure 17:
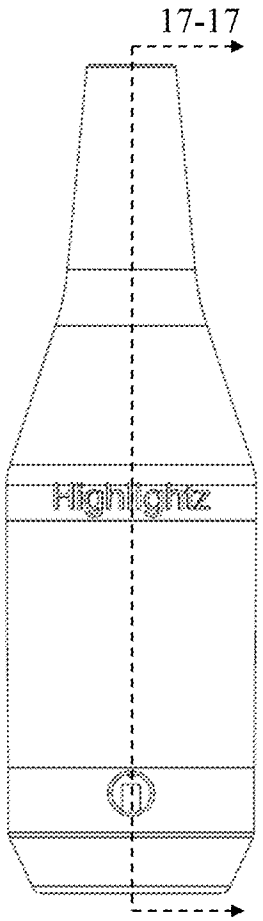
FIG. 17 is an elevational rear view of the illuminating handheld smoking article in FIG. 16.
Figure 16:
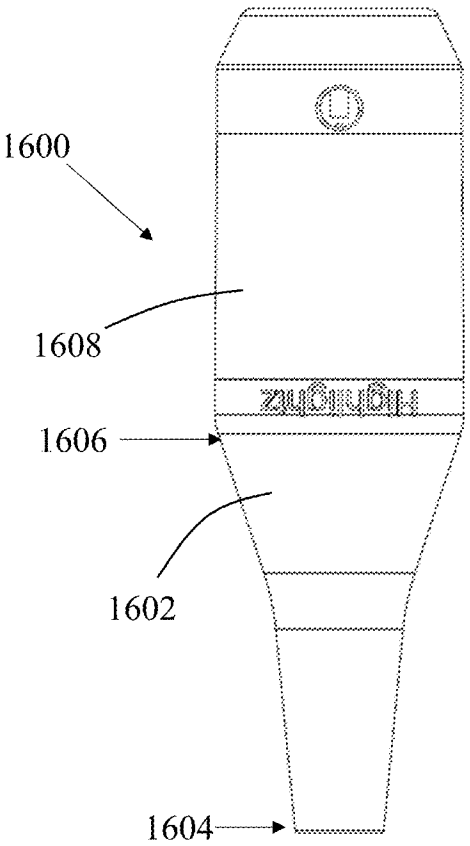
FIG. 16 is an elevational front view of an illuminating handheld smoking article in accordance with one embodiment of the present invention.
Figure 18:
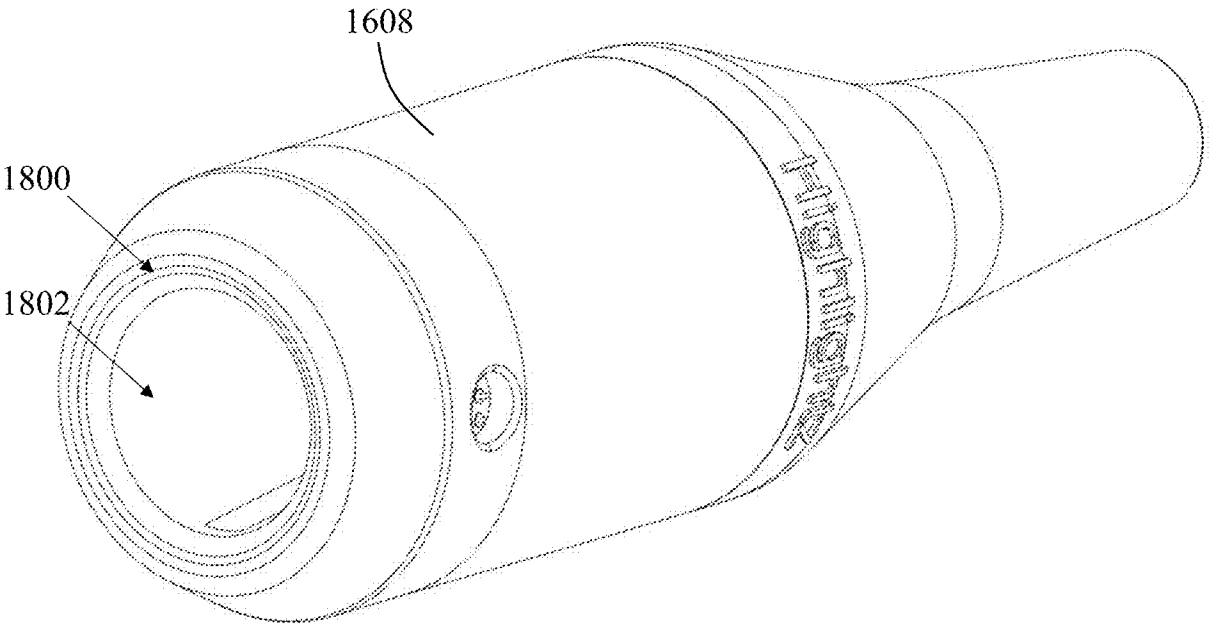
FIG. 18 is a perspective view of the illuminating handheld smoking article in FIG. 16.
Figure 19:
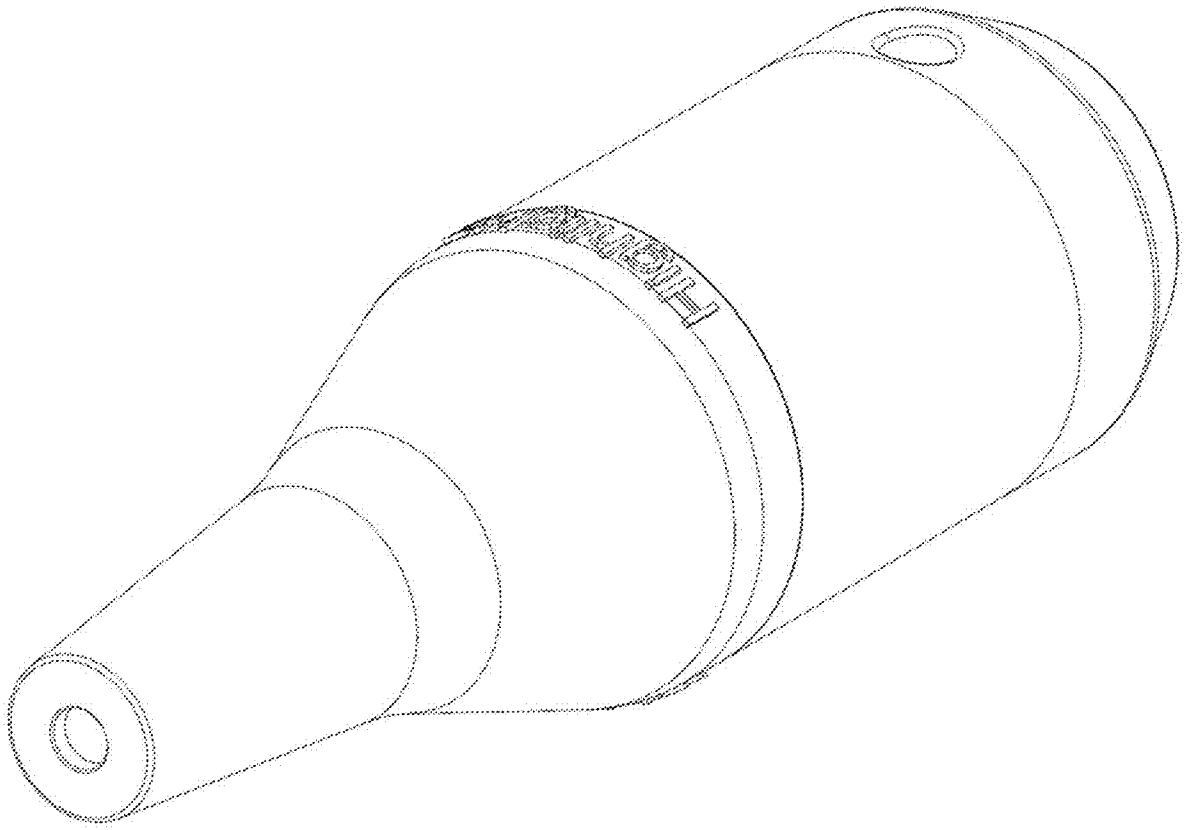
FIG. 19 is another perspective view of the illuminating handheld smoking article in FIG. 16.

Although the block diagram of FIG. 15 shows a specific method of coupling the components, the order and types of components may be changed relative to the other components shown in different embodiments.

Referring now to FIGS. 16-25, another embodiment of the present invention is shown. FIGS. 16-25 show several advantageous features of the present invention, but, as will be described below, the invention can be provided in several shapes, sizes, combinations of features and components, and varying numbers and functions of the components. The second example of an illuminated handheld smoking article 1600, as shown in FIGS. 16-25 (with reference to FIG. 15), includes a handheld body 1602 with a first end 1604 defining an opening 2000, a second end 1606 opposite the first end 1604 and defining an opening 2002, defining a body air passageway 2004 separating the openings 2000, 2002 defined by the first and second ends 1604, 1606, respectively, of the handheld body 1602. The illuminated handheld smoking article 1600 may have an approximate length of 60 mm with various sized openings and apertures ranging from 2 mm to 20 mm. The illuminated handheld smoking article 1600 may be one continuous piece or more than one piece coupled together that includes some or all of the components and features described herein. Additionally, more than one type of material, ranging from opaque to transparent and permeable to impermeable, may be used in manufacturing the illuminated handheld smoking article 1600 based on the individual component requirement. The handheld body 1602 may be of a substantially rigid polymeric material that is heat resistant, such as polypropylene. The features and components of the illuminated handheld smoking article 100 in FIGS. 1-3 may similarly be present in the illuminated handheld smoking article 1600 in FIGS. 16-25.

The article 1600 also comprises an LED cover 1608 with a first end 2006 defining an opening 2500, a second end 1800 opposite the first end 2006 of the LED cover 1608 and defining an opening 1802, having an inner wall 2008 enclosing and defining a cover air passageway 2010 separating the openings 2500, 1802 defined by the first and second ends 2006, 1800, respectively, of the LED cover 1608. The LED cover 1608 also has an outer wall 2012 of a translucent material, e.g., a polymeric material such as polypropylene, a ceramic material, etc., that extends around the outer circumference and includes an LED 2018 that may be disposed on opposing sides of the LED cover 1608 or may be of an annular or cylindrical shape. The LED 2018 utilized by the article my beneficially emit a light within the range of 500-800 lumens and, because it one or a few LED bulbs housed within LED cover 1608, generates the appearance that light surrounds the entire LED cover 1608, or beneficially 40-70% of the entire length of the article. The LED 2018 may also be operably configured to emit a pulsating light or constant light when triggered by the activation circuit 1500 to draw more attention to the article. The LED cover 1608 may define, specifically the inner wall 2008 and the outer wall 2012 of the LED cover 1608, a cylindrical LED cavity 2014 that may surround the LED cover 1608. The body air passageway 2004 and the cover air passageway 2010 define a continuous article air passageway 2016 separating the opening 2000 defined by the first end 1604 of the handheld body 1602 and the opening 1802 defined by the second end 1800 of the LED cover 1608. Whereas in another embodiment, the outer wall 2012 is of a translucent material spanning from the second end 1800 of the LED cover 1608 to the first end 2006 or the LED cover material is transparent for greater light emission and detection from a distance. In one embodiment, the LED cover 1608 may be composed of a glass or plexiglass material. In one embodiment, the inner wall 2008 may be lined (on one or both sides) with an insulating material, such as mineral wool, polyurethane, or glass.

The article 1600 includes an LED assembly 2502 positioned within the LED cavity 2014 and having at least one LED 2018 of an annular or other shape that is operably configured to emit light radially outwardly from the surrounding outer wall 2012 of the LED cover 1608. In another embodiment, the LED cavity 2014 and the LED 2018 are cylindrical. The illuminated handheld smoking article 1600 has an LED activation assembly 1510 which is fluidly coupled to the body air passageway 2004 and has an activation circuit 1500. In addition, the LED activation assembly 1510 may have a self-contained power source 1502 that is electrically coupled to the LED assembly 2502 and the activation circuit 1500 which is operably configured to selectively and autonomously complete a circuit with at least one LED 2018 upon receiving airflow or an ambient pressurization (caused by suction from the user) at least partially through the body air passageway 2004 (and within the LED cavity 2014) and emit light radially outwardly from the surrounding outer wall 2012 of the LED cover 1608. In another embodiment, at least one LED 2018 is positioned directly adjacent to an inner surface 2020 of the outer wall 2012 of the LED cover 1608.

In another embodiment, where the LED activation assembly 1510 includes an electronic airflow sensor 2504, e.g., similar to the sensor disclosed in Han et al., U.S. Pat. No. 10,104,909, which is incorporated herein by reference, that is electrically coupled to the self-contained power source 1502 and the activation circuit 1500 is operably configured to selectively and autonomously complete the circuit with at least one LED and the self-contained power source 1502 upon receiving an airflow or pressurization across the electronic airflow sensor 2504. In addition, the electronic airflow sensor 2504 may be positioned in the LED cavity 2014 within the LED cover 1608.

Figure 20:
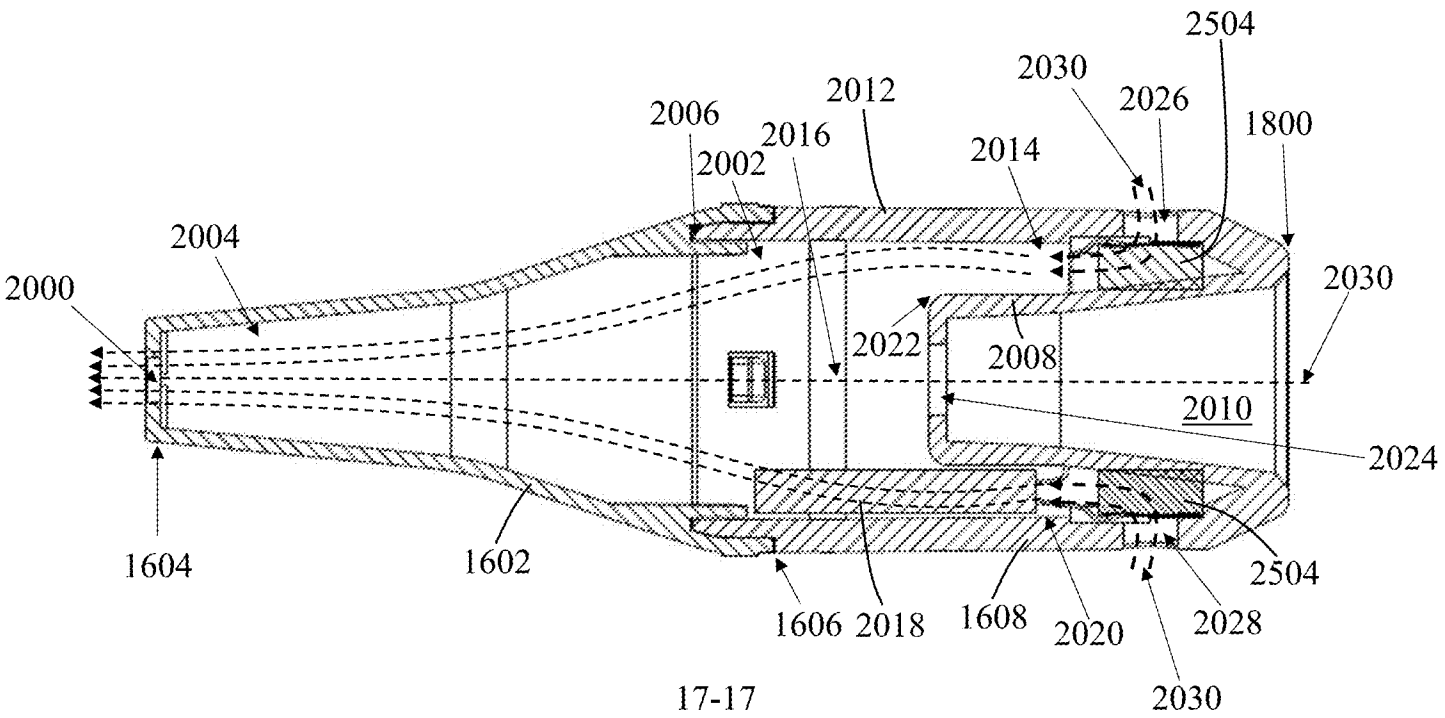
FIG. 20 is a cross-sectional view of the illuminating handheld smoking article in FIG. 17 along section line 17-17.
Figure 23:
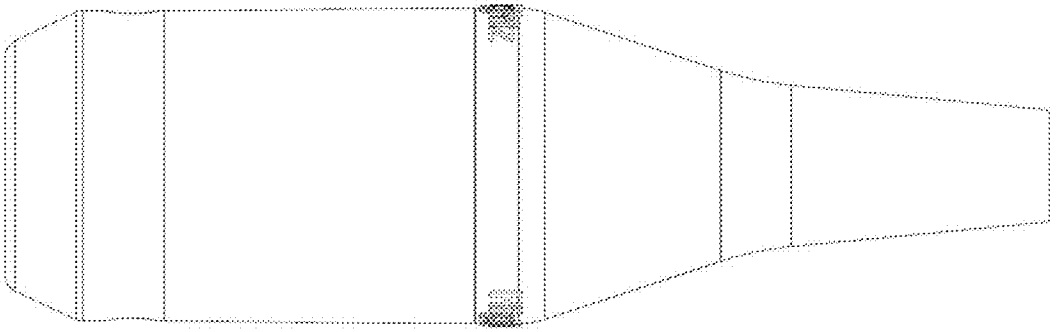
FIG. 23 is a projection view of an illuminating handheld smoking article in accordance with one embodiment of the present invention.
Figure 24:
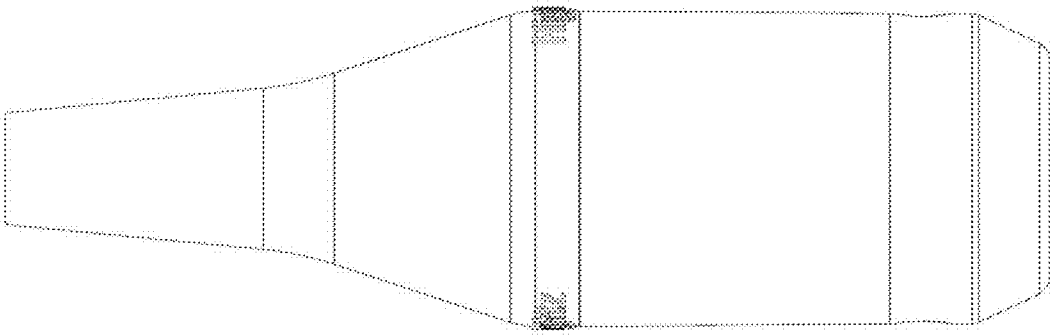
FIG. 24 is another projection view of the illuminating handheld smoking article in FIG. 23.
Figure 21:
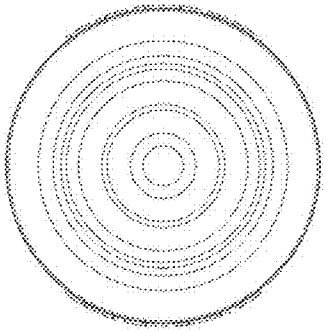
FIG. 21 is a top plan view of the illuminating handheld smoking article in FIG. 23.
Figure 22:
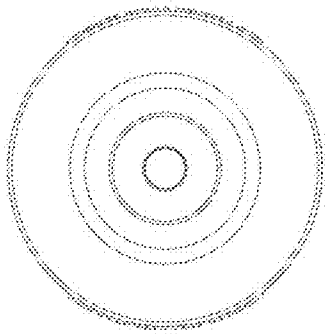
FIG. 22 is a bottom plan view of the illuminating handheld smoking article in FIG. 23.
Figure 25:
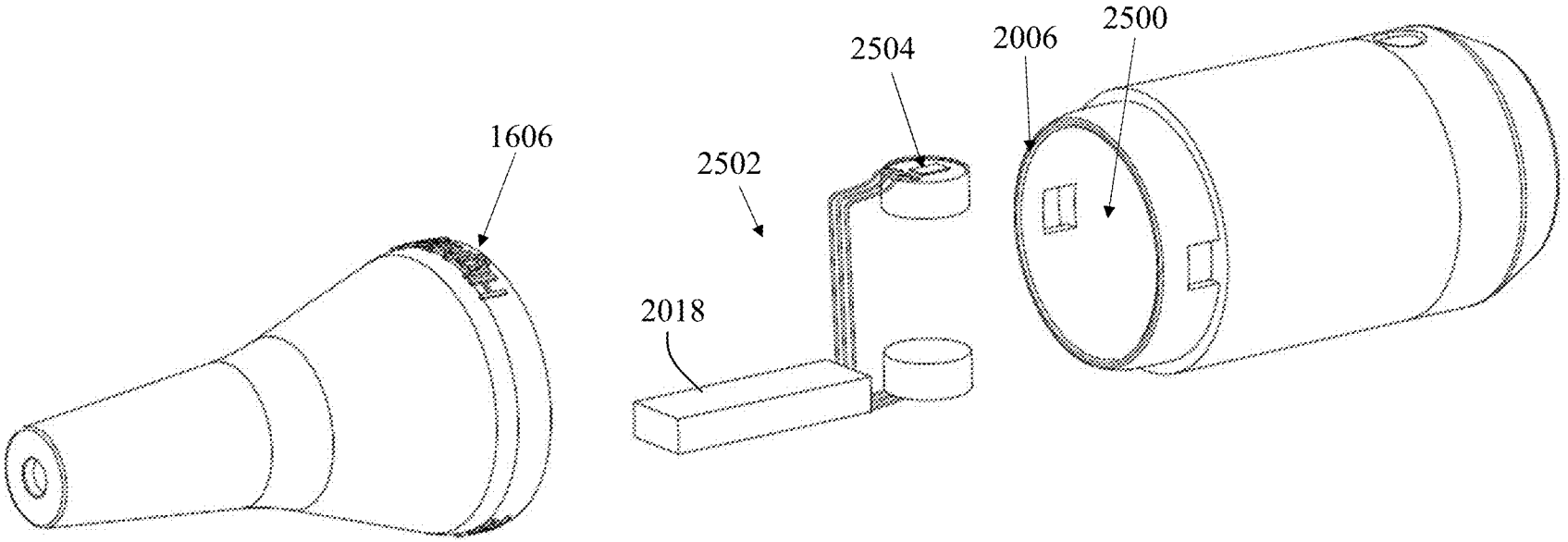
FIG. 25 is an exploded view of a handheld body, LED activation assembly, and LED cover utilized in the illuminating handheld smoking article in accordance with one embodiment of the present invention.

The outer wall 2012 and the inner wall 2008 are preferably concentrically aligned and positioned in a longitudinal orientation that forms a joint defining the second end 1800 of the LED cover 1608. Said another way, the outer wall 2012 and the inner wall 2008 form a double-walled structure extending longitudinally from a joint disposed at the first end 2006 of the LED cover 1608 and toward the first end 1604 of the handheld body 1602 and with the LED cavity 2014 of a cylindrical shape. The inner wall 2008 extends inwardly from the second end 1800 of the LED cover 1608 (approximately 0.5-2 inches) and terminates at an inner wall free end 2022 which creates an inner wall aperture 2024 (of a diameter ranging from approximately 0.25-1 inches). In another embodiment, the outer wall 2012 can have at least one enclosed intake aperture 2026 located proximal (e.g., at or within approximately 15-20% of the overall article longitudinal length) to the second end 1800 of the LED cover 1608 that is fluidly coupled to the LED cavity 2014. The opening 2002 and the body air passageway 2004 are defined by the handheld body 1602. Preferably, the outer wall 2012 includes two enclosed intake apertures 2026, 2028 located on opposite sides to facilitate in drawing in outside air 2030 (as depicted in FIG. 20) into the LED cavity 2014. Moreover, at least one LED 2018 is disposed within the LED cavity 2014 and positioned directly adjacent and directly coupled to an inner surface 2020 of the outer wall 2012 of the LED cover 1608.

In one embodiment, the switch/sensor circuit the electronic airflow sensor(s) 2504 is adhesively coupled to one or both of the inner wall 2008 or outer wall 2012. In another embodiment, the LED cover 1608 is molded around the electronic airflow sensor(s) 2504. Preferably, but not necessarily, two electronic airflow sensors 2504 are positioned proximal to the intake aperture 2026, 2028 to allow air 2030 to pass through or over the sensors 2504 and through the body air passageway 2004, the cover air passageway 2010, and/or the entire continuous article air passageway 2016. As such, the article will enable the user to smoke an item, such as a cigarette, by inserting a portion of the item within the cover air passageway 2010 until reaching the opening 2024 or otherwise being retained by the inner wall 2008. To that end, the inner wall may advantageously taper in diameter, thereby enabling the wall 2008 to compressively retain the smoking item. When desired for use, the user will inhale or apply a suction pressure within the passageway 2010 and the area in which the sensor 2504 is stored, e.g., within the LED cavity 2014. Testing has shown that a more effective suction force is generated on the item being smoked with the internal wall configuration and intake aperture(s) placement depicted in FIG. 20. Testing has also shown that a quicker and more effective localized pressure or airflow through or around the sensor 2504 is generated with the internal wall configuration and intake aperture(s) placement depicted in FIG. 20. More specifically, the internal configuration and aperture placement (i.e., longitudinal placement after the opening 2014) has been tested to effectuate greater internal pressures and airflows. To that end, the LED cavity 2014 may taper in diameter towards the second end 1800 to direct incoming ambient air 2030 though the article 1600.

The outer wall 2012 may be rotatably, selectively, and removably coupled to the handheld body 1602 using a snap fit configuration or tongue-and-groove configuration. As such, the user may be able separately remove and rotate the LED cover 1608 (which preferably, but not necessarily, houses all of the electronic components) so that the handheld body 1602 can be independently cleaned. In other embodiments, the LED cover 1608 may be affixed to the outer wall 2012 inhibiting rotation thereof and removal therefrom.

Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the above described features.

What is claimed is:

1. An illuminated handheld smoking article comprising:

a terminal end of the illuminated handheld smoking article and another terminal end of the illuminated handheld smoking article opposite the terminal end of the illuminated handheld;

a handheld body with a first end defining an opening and defining a terminal end of the handheld body aligned with the terminal end of the illuminated handheld smoking article, a second end opposite the first end and defining an opening, defining a body air passageway separating the openings defined by the first and second ends, respectively, of the handheld body;

an LED cover directly coupled to the handheld body and with a first end directly coupled to the second end of the handheld body and defining an opening, a second end opposite the first end of the LED cover, defining a terminal end of the LED cover aligned with the another terminal end of the illuminated handheld smoking article opposite the terminal end of the illuminated handheld smoking article aligned with the terminal end of the handheld body, and defining an opening, having an inner wall enclosing and defining a cover air passageway separating the openings defined by the first and second ends, respectively, of the LED cover, and having an outer wall of a translucent material defining a perimeter thereon and enclosing and defining, with the inner wall, a LED cavity, the body air passageway and the cover air passageway defining a continuous article air passageway separating the opening defined by the terminal first end of the handheld body and the opening defined by the terminal second end of the LED cover, the cover air passageway and the opening defined by the terminal second end of the LED cover sized to have a smoking item inserted therein and with the inner wall of the LED cover configured to retain the smoking item within the cover air passageway;

an LED assembly disposed within the LED cavity and having at least one LED operably configured to emit light radially outwardly from and surrounding the outer wall of the LED cover;

an LED activation assembly coupled to the illuminated handheld smoking article, fluidly coupled to the body air passageway, and having an activation circuit; and a self-contained power source electrically coupled to the LED activation assembly, the activation circuit, and the LED assembly, the activation circuit operably configured to selectively and autonomously complete a circuit with the at least one LED and the self-contained power source upon detecting an airflow with the LED activation assembly at least partially within the body air passageway and emit light radially outwardly from and surrounding the outer wall of the LED cover.

2. The illuminated handheld smoking article according to claim 1, wherein:

the inner wall and the outer wall form a double-walled structure extending longitudinally from a joint disposed at the first end of the LED cover and toward the first end of the handheld body and with the LED cavity of a cylindrical shape.

3. The illuminated handheld smoking article according to claim 1, wherein:

at least one LED is positioned directly adjacent to an inner surface of the outer wall of the LED cover.

4. The illuminated handheld smoking article according to claim 1, wherein the LED activation assembly further comprises:

an electronic airflow sensor electrically coupled to the self-contained power source, the activation circuit operably configured to selectively and autonomously complete the circuit with at least one LED and the self-contained power source upon receiving an airflow across the electronic airflow sensor.

5. The illuminated handheld smoking article according to claim 4, wherein:

the electronic airflow sensor is disposed in the LED cavity.

6. The illuminated handheld smoking article according to claim 1, wherein:

the outer wall and the inner wall are disposed in a longitudinal orientation and form a joint defining the second end of the LED cover, and the inner wall includes a portion extending inwardly from the second end of the LED cover and terminating at an inner wall free end enclosing an inner wall aperture.

7. The illuminated handheld smoking article according to claim 6, wherein:

at least one LED is disposed within the LED cavity and positioned directly adjacent and directly coupled to an inner surface of the outer wall of the LED cover.

8. The illuminated handheld smoking article according to claim 7, wherein the outer wall further comprises:

two enclosed intake apertures disposed and defined on two opposing sides of the outer wall.

9. The illuminated handheld smoking article according to claim 6, wherein the outer wall further comprises:

at least one enclosed intake aperture disposed proximal to the second end of the LED cover and fluidly coupled to the LED cavity and the opening and the body air passageway defined by the first end of the handheld body.

10. The illuminated handheld smoking article according to claim 6, wherein:

the inner wall extends inwardly from the second end of the LED cover approximately 0.5-2 inches until terminating at the inner wall free end.

11. An illuminated handheld smoking article comprising:

a terminal end of the illuminated handheld smoking article and another terminal end of the illuminated handheld smoking article opposite the terminal end of the illuminated handheld;

a handheld body with a first end defining an opening and defining a terminal end of the handheld body aligned with the terminal end of the illuminated handheld smoking article, a second end opposite the first end and defining an opening, defining a body air passageway separating the openings defined by the first and second ends, respectively, of the handheld body;

an LED cover with a first end directly coupled to the second end of the handheld body and defining an opening, a second end opposite the first end of the LED cover and defining an opening and aligned with the another terminal end of the illuminated handheld smoking article opposite the terminal end of the illuminated handheld smoking article aligned with the terminal end of the handheld body, having an inner wall enclosing and defining a cover air passageway separating the openings defined by the first and second ends, respectively, of the LED cover, and having an outer wall of a translucent material defining a perimeter thereon and enclosing and defining, with the inner wall, a cylindrical LED cavity, the body air passageway and cover air passageway defining a continuous article air passageway separating the opening defined by the terminal first end of the handheld body and the opening defined by the terminal second end of the LED cover, the cover air passageway and the opening defined by the terminal second end of the LED cover sized to have a smoking item inserted therein and with the inner wall of the LED cover configured to retain the smoking item within the cover air passageway;

an LED assembly disposed within and surrounding the cylindrical LED cavity and having at least one LED operably configured to emit light radially outwardly from and surrounding the outer wall of the LED cover;

an LED activation assembly coupled to the handheld body, at least partially disposed within the body air passageway, and having an activation circuit; and a self-contained power source electrically coupled to the LED activation assembly, the activation circuit, and the LED assembly, the activation circuit operably configured to selectively and autonomously complete a circuit with at least one LED and the self-contained power source solely when receiving an airflow through the continuous article air passageway and emit light radially outwardly from the outer wall of the LED cover.

12. The illuminated handheld smoking article according to claim 11, wherein:

the opening defined by the first end of the handheld body and the opening defined by the second end of the LED cover are enclosed.

13. The illuminated handheld smoking article according to claim 11, wherein the LED activation assembly further comprises:

a sensor electrically coupled to the self-contained power source.

14. The illuminated handheld smoking article according to claim 11, wherein the LED activation assembly further comprises:

a spring-loaded lever assembly having an electrical switch electrically coupled to the self-contained power source.

15. The illuminated handheld smoking article according to claim 11, wherein:

the inner wall of the LED cover is coupled to the handheld body in a hermetically sealed configuration.

16. The illuminated handheld smoking article according to claim 15, wherein the inner wall of the LED cover further comprises:

a discontinuous slot formed thereon and extending from the first end of the LED cover, wherein a portion of the LED activation assembly is disposed within the discontinuous slot.

17. The illuminated handheld smoking article according to claim 11, wherein:

the outer wall is of a translucent material spanning from the second end of the LED cover to the first end.

18. The illuminated handheld smoking article according to claim 11, wherein:

the outer wall is extended with an impermeable material to fully enclose the smoking item.

19. The illuminated handheld smoking article according to claim 11, wherein:

the inner wall is extended with an impermeable material to fully enclose the smoking item.

20. The illuminated handheld smoking article according to claim 11, wherein:

the outer wall and the inner wall are disposed in a longitudinal orientation and form a joint defining the second end of the LED cover, and the inner wall includes a portion extending inwardly from the second end of the LED cover approximately 0.5-2 inches until terminating at an inner wall free end enclosing an inner wall aperture.

* * * * *